United States Patent [19]

Chen et al.

[11] Patent Number: 5,064,465

[45] Date of Patent: Nov. 12, 1991

[54] PROCESS FOR PREPARING RARE EARTH-IRON-BORON ALLOY POWDERS

[75] Inventors: Chi J. Chen, Kaohsiung; Cheng H. Lin, Taipei Hsien; Tin Y. Liu, Hsinchu Hsien; Ying C. Hung, Taichung Hsien, all of Taiwan

[73] Assignee: Industrial Technology Research Institute, Taiwan

[21] Appl. No.: 619,724

[22] Filed: Nov. 29, 1990

[51] Int. Cl.[5] ..... H01F 1/06; H01F 41/02

[52] U.S. Cl. ..... 75/349; 148/101; 148/105

[58] Field of Search ..... 75/348, 349, 255; 148/100, 101, 105, 302

[56] References Cited

U.S. PATENT DOCUMENTS

| | | | |
|---|---|---|---|
| 4,541,877 | 9/1985 | Stadelmaier et al. | 148/101 |
| 4,601,754 | 7/1986 | Ghandehari | 75/255 |
| 4,767,450 | 8/1988 | Ishigari et al. | 148/302 |
| 4,769,063 | 9/1988 | Ishigaki et al. | 148/302 |
| 4,806,155 | 2/1989 | Camp et al. | 75/349 |
| 4,834,812 | 5/1989 | Ghandehari | 148/101 |
| 4,878,958 | 11/1989 | Ghandehari | 148/105 |
| 4,917,724 | 4/1990 | Sharma | 148/302 |
| 4,944,801 | 7/1990 | Ishikawa et al. | 148/105 |
| 4,952,252 | 8/1990 | Ghandehari | 148/105 |

FOREIGN PATENT DOCUMENTS

| | | | |
|---|---|---|---|
| 60-77943 | 5/1985 | Japan | 148/302 |
| 61-119642 | 6/1986 | Japan | 148/302 |
| 62-4806 | 1/1987 | Japan | 75/349 |
| 62-4807 | 1/1987 | Japan | 75/349 |
| 62-262406 | 11/1987 | Japan | 75/349 |
| 62-262407 | 11/1987 | Japan | 75/349 |

*Primary Examiner*—R. Dean
*Assistant Examiner*—George Wyszomierski
*Attorney, Agent, or Firm*—Scully, Scott, Murphy & Presser

[57] ABSTRACT

A process for preparing by a reduction/diffusion method rare earth-iron-boron alloy powders useful in permanent magnets. The process generates rare earth-iron-boron alloy powders having large and uniform particle sizes with minimal contamination. The process entails the use of a seed alloy among the starting materials, the seed alloy having substantially the same composition as the rare earth-iron-boron alloy to be prepared.

45 Claims, 1 Drawing Sheet

PROCESS FOR PREPARING RARE EARTH-IRON-BORON ALLOY POWDERS

BACKGROUND OF THE INVENTION

1. Field of the Invention

The present invention relates to a process for preparing rare earth-iron-boron alloy powders by a reduction/diffusion method. The present invention is also directed to the powders thus produced which are useful in permanent magnets and related technology. The present invention is also directed to articles which use the alloy powders produced by the instant process.

2. Background of the Prior Art

Alloys which contain rare earths, i.e., those elements with atomic numbers 57 to 71 as their principal components, are used in a variety of areas, including permanent magnets, magnetostrictive materials, opto-magnetic recording materials, hydrogen occlusion materials, and magnetic sensors.

Magnets utilizing these alloys exhibit excellent properties. One such alloy which has particular utility in permanent magnets, is formed from a rare earth, iron and boron. This alloy is generally described by the formula R—Fe—B, wherein R signifies one or more rare earth elements, Fe signifies iron, and B, boron. Two processes currently exist for the preparation of R—Fe—B alloy powders. The first process is a powder preparation method; the second process is a reduction/-diffusion method. In the first method, which is a powder metallurgy process, ingots of rare earth metals and other alloying elements are melted using a high frequency melting furnace to form the R—Fe—B alloy which is subsequently crushed into powders. However, it is difficult to make the R—Fe—B alloy powders in this manner because the rare earth metals are easily oxidized during the crushing operation, which result adversely affects the quality of the final product.

To eliminate this drawback, a reduction/diffusion method has been developed. The starting materials for this method consist of rare earth metal oxides, iron powders, and ferroboron powders, all of which are admixed with calcium granules which act as a reducing agent. Cobalt powders and aluminum oxide may also be present in the starting materials. The mixture obtained is dry pressed and heated in either an inert gas atmosphere or under vacuum in order to reduce the rare earth metal oxide by contact with the resultant melt and/or by contact with the vapor coming from the calcium granules. The rare earth metal which is formed by this reduction then diffuses into the particles of ferroboron, iron (and cobalt and aluminum oxide, if these are present). While this method permits the formation of an R—Fe—B alloy powder having a uniform composition, it suffers the drawback of providing an impure product: the reaction product, obtained in the form of a sintered mass, is a mixture of calcium oxide, CaO, which is formed as a by product of reaction, unreacted excess calcium, and the desired R—Fe—B alloy powder.

When the sintered mass is crushed and placed into water, the CaO and the unreacted excess metallic calcium react with the water to form calcium hydroxide, $Ca(OH)_2$. The desired R—Fe—B alloy powder can then be separated from the $Ca(OH)_2$ because the $Ca(OH)_2$ remains suspended in the water, while the R—Fe—B alloy powder becomes a slurry which settles upon standing. The water containing the $Ca(OH)_2$ suspension is physically removed from the settled R—Fe—B alloy powder slurry by decantation, for example. Residual $Ca(OH)_2$ is removed by washing the R—Fe—B alloy powder slurry with an acid. Upon drying, the R—Fe—B alloy powder is obtained. Since rare earths in oxide form cost less than ingots of rare earth metals, as used in the powder metallurgy method, it is the reduction/diffusion method which is the subject of intense interest to those in the magnetic material industry.

Accordingly, the reduction/diffusion method has undergone extensive development since the use of rare earth-iron-boron ally materials, such as neodymium-iron-boron (Nd—Fe—B), in permanent magnets was disclosed in the seminal work of J. J. Croat, et al. (J. Appl. Phys., 55(6), 2078 (1984) and M. Sagawa, et al. (J. Appl. Phys., 55(6), 2083 (1984)). Refinements of this process usually recognize that for the reduction/diffusion method to be most effective it is important to prevent the rare earth metal from being oxidized as processing proceeds and to remove residual calcium as completely as possible.

One line of development is set forth in Japanese patents JP 62004807, JP 62004806, JP 61295308 and JP 61270303 which all disclose the addition of alkaline earth metal chlorides to the starting materials for the reduction/diffusion method. Alkaline earth metal chlorides have low melting points and form a liquid phase during the reduction/diffusion process, which allows the alkaline earth metal chlorides to permeate into the grains of the reduction/diffusion reaction product. As a result of this permeation, the reduction/diffusion reaction product, which contains the desired R—Fe—B alloy, will disintegrate more completely to form individual particles during the wet process, the wet process being the subsequent steps involving water and, if necessary, acid. This level of disintegration, which stems from the use of alkaline earth metal chlorides, facilitates the removal of the residual calcium. However, although the alkaline metal chlorides in the reduction/diffusion method effectuates the eventual removal of calcium contaminant, their use causes other problems.

One disadvantage in adding alkaline earth metal chlorides to the starting materials is the difficulty they cause in controlling the size of the individual alloy particles. The size of the individual alloy particles is important because it determines the extent of any subsequent oxidation the particles may undergo and further determines the extent of calcium removal. If the particle diameter is below 10 microns (μm), it will be more readily oxidized, leading to degradation of magnetic properties. If the particle size is too large, it will be difficult to remove residual calcium.

Another disadvantage to the alkaline earth metal chloride technique stems from the low melting points of the chlorides. Low melting points lead to the contamination of the reduction/diffusion furnace which adversely affects product quality and is disruptive to overall processing.

Hence there is a continuing need for improvements in methods for preparing rare earth-iron-boron alloy powders.

SUMMARY OF THE INVENTION

An improved process for preparing rare earth-iron-boron alloy powders via a reduction/diffusion method has now been developed. The alloy powders thus produced find utility in permanent magnets and magnetic-related technology. The process of the present invention allows control over the particle sizes of the alloy powder to a degree where large, uniform sizes may be obtained thus minimizing subsequent oxidation. Moreover, these sizes may be obtained without contamination problems normally attendent larger grain sizes; the process of the present invention being able to minimize to a degree heretofore not possible, the contamination caused, for example, by calcium and calcium residues. Further, the process of the present invention achieves these results without requiring the use of alkaline earth metal chlorides, thus eliminating problems associated therewith.

The present invention is also directed to rare earth-iron-boron alloy powders made by the subject process, as well as articles—such as permanent magnets—which comprise the alloys thus made.

DETAILED DESCRIPTION OF THE INVENTION

Figure 1:
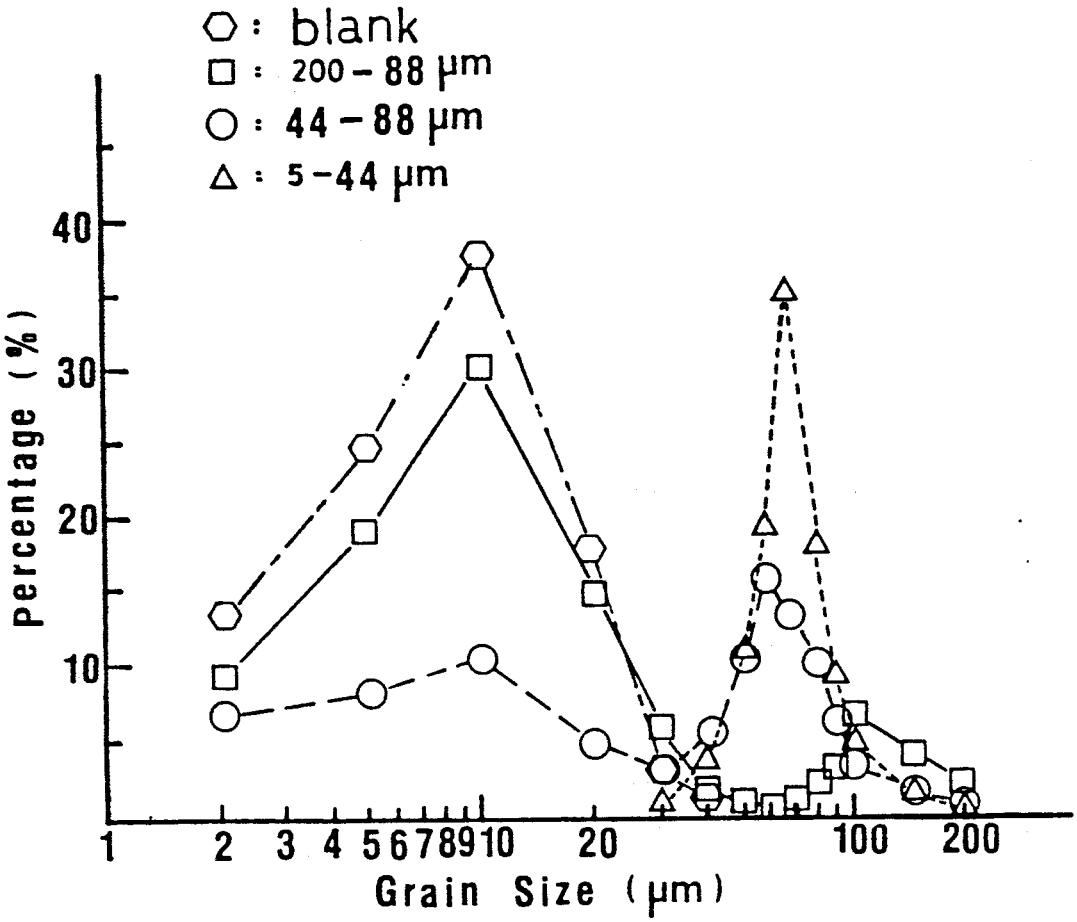
FIG. 1 illustrates the grain size distribution of a rare earth-iron-boron alloy powder obtained by the process of the present invention.

The process of the present invention is directed to the preparation of rare earth alloy powders via a reduction/diffusion method. The process of the present invention is notably characterized by the addition of a seed alloy—that is, a small amount of a rare earth-iron-boron alloy powder having substantially the same composition as that of the rare earth-iron-boron alloy powder targeted for preparation—to the starting materials.

The starting materials employed in the process of the present invention consist of at least one rare earth oxide, at least one ferroboron-containing compound, calcium, iron, and optionally, cobalt and/or aluminum oxide.

The rare earth oxide component includes an oxide formed from at least one element having atomic number 57 to 71. Mixtures of oxides of any of these elements may also be used. Preferred rare earth metal oxides are those formed from neodymium (Nd) and/or praseodymium (Pr). In a second embodiment, rare earth oxides formed from dysprosium (Dy), cerium (Ce), lanthanum (La), promethium (Pm), samarium (Sm), europium (Eu), gadolinium (Gd), terbium (Tb), holmium (Ho), erbium (Er), thulium (Tm), ytterbium (Yb) and/or lutetium (Lu) are included in the starting materials in conjunction with oxides formed from neodymium and/or praseodymium. The inclusion of these particular rare earth oxides with oxides of neodymium and/or praseodymium in starting materials may be required to meet the needs of a particular end use.

The amount of rare earth oxide present in the starting materials may be up to about 40% by weight, based on the total weight of the starting material plus the seed alloy. Preferably, the amount of rare earth oxide is present in an amount of between about 25% to about 30% based on total weight of starting materials plus the seed alloy. In the practice of the second embodiment, any rare earth oxides present in addition to those formed from neodymium and/or praseodymium, are present in an amount of up to about 10% by weight based on the total weight of the starting materials plus the seed alloy; preferably, this amount is between about 3% to about 4.5% by weight based on the total weight of the starting materials plus the seed alloy.

The ferroboron-containing compounds useful in the practice of the present invention are those which include a boron-iron (B—Fe) alloy as a constituent. Preferably, the boron-iron alloy is present in the ferroboron-containing compound in an amount of between about 10% to about 30% by weight based on the total weight of the ferroboron-containing compound; more preferably, this amount is about 20% by weight. The ferroboron-containing compound is, in turn, present in the starting materials in an amount up to about 10% by weight based on the total weight of the starting materials plus the seed alloy. Preferably, the ferroboron-containing compound is present in an amount of between about 4% to about 6% by weight based on the total weight of the starting materials plus the seed alloy.

The calcium component of the starting materials is preferably in the form of granules. Calcium is present in the starting materials in an amount which is about 1.0 to about 3.0, preferably 1.1–2.0, times the stoichiometric amount necessary for the reduction of the rare earth oxide component and any aluminum oxide which may be present. Generally this amount of calcium in the starting materials corresponds to an amount of up to about 30% by weight, based on the total weight of starting materials plus the seed alloy. Usually in this regard calcium is present in an amount of between about 15% to about 20% by weight.

The iron component of the starting materials is preferably in the form of powder. Iron is present in the starting materials in an amount of up to 50% by weight, based on total weight of starting materials plus the seed alloy. Preferably, the iron component is present in an amount of between about 30% to about 45% by weight based on the total weight of the starting materials plus the seed alloy.

Cobalt may optionally be present in the starting materials, depending upon the desired rare earth-iron-boron alloy powder to be prepared. Generally, for most practical applications, cobalt may be present in an amount of up to about 20% by weight based on the total weight of the starting materials plus the seed alloy. Preferably, cobalt, when present, is present in an amount of between about 10% to about 15% by weight.

Also depending upon the desired rare earth-iron-boron alloy powder to be prepared, aluminum oxide ($Al_2O_3$) may optionally be present among the starting materials. Generally, for most practical applications, aluminum oxide may be present in an amount of up to about 5% by weight of the starting materials plus the seed alloy. Preferably, the aluminum oxide, when present, is present in an amount of between about 0.5% to about 2% by weight.

The seed alloy material used in the practice of the present invention has substantially the same composition as the rare earth alloy to be prepared. Generally, the composition of rare earth alloy powders useful for such items as permanent magnets can be represented formulaically as:

$$R_xT_{(100-x-y)}B_y$$

wherein R represents one or more of the rare earth elements having atomic numbers 57 to 71. Rare earths which are particularly useful in magnetics include neodymium and praseodymium, either alone or in combination. Other useful rare earths in this regard include dysprosium, cerium, lanthanum, promethium, samarium, europium, gadolinium, terbium, holmium, erbium, thulium, ytterbium and lutetium. In practical applications, these other useful rare earths are normally present in conjunction with neodymium and/or prasedymium. The subscript "x" represents a number between 13–20.

T represents iron, and cobalt and/or aluminum if either or both of the latter two are present in the formulation. The subscript "y" represents a number between 5–12.

B represents boron.

Once the composition of the rare earth-iron-boron alloy to be prepared is decided upon, a seed alloy having substantially the same formula can be provided. The seed alloy is added to the starting materials in an amount of up to about 20% by weight based on the projected amount of rare earth-iron-boron alloy to be prepared. Preferably, the seed alloy is present in an amount of between about 2% to about 10% by weight based on the projected amount of rare earth-iron-boron alloy to be prepared; most preferably, the seed alloy is present in an amount of about 5% by such weight.

The seed alloy is normally used in particulate form having a size in the range of between about 1 to about 200μm. The preferred size is in the range of between about 5 to about 44μm.

Procedurally, the starting materials—including the seed alloy—is mixed and then dry pressed, preferably into pellets. The pellets are then placed into a stainless steel container which is subsequently placed into a tubular furnace wherein the reduction/diffusion reaction proceeds at a temperature of between about 800° C. to about 1300° C. under vacuum or in an inert atmosphere; in the practice of the invention, an argon atmosphere is preferred. The seed alloy powder promotes the formation of grains having large and uniform diameters. The seed alloy powder further causes calcium oxide (formed in the course of the reaction) and unreacted calcium to aggregate around the grain boundaries during the reduction/diffusion reaction, which phenomenon, after subsequent crushing, facilitates the removal of the unreacted calcium and the calcium oxide during later wet processing with water and, if necessary, a mild acid. This increased removal also helps keep the oxygen content low.

The reduction/diffusion reaction product (now in the form of reacted compacts) is cooled down in the furnace to room temperature. The reacted compacts are then discharged from the furnace and powdered to below about 60 mesh. The powder thus obtained is then placed into water, preferably deionized water, under an inert atmosphere, preferably nitrogen. It is preferred that the water be agitated by, for example, stirring at about 1000–5000 rpm. The contact with water causes the disintegration of the powder. Calcium oxide formed from the reaction, and unreacted calcium, react with water to form $Ca(OH)_2$ and $H_2$. After approximately 30 minutes, the alloy powders disintegrate to the point where a slurry is formed. The alloy particles can thus be separated from the $Ca(OH)_2$ and $H_2$: the $H_2$ escapes as gas, and the $Ca(OH)_2$ remains suspended in the water while the slurry is allowed to settle. Upon decantation, $Ca(OH)_2$ and water are removed.

Water, preferably deionized water, is then added to the settled solids and a washing and decantation process is repeated several times. A dilute acid, such as acetic acid, may be added dropwise to adjust the pH value to between about 4 to about 10. This results in a more effective removal of residual calcium. The alloy particles are then filtered, by standard filtration techniques, and washed several times with water, preferably deionized water, until the pH value is between about 6 to about 7. Trace water remaining with the alloy particles is removed by acetone which is, in turn, removed by vacuum drying. The rare earth-iron-boron alloy, in powder form, is thus obtained.

The composition of the powders may be analyzed by using methods such as Inductively Coupled Plasma-Atomic Emission Spectroscopy (ICP-AES), Atomic Absorption Spectroscopy and Nitrogen/Oxygen analysis. A permanent magnet may be obtained by ball milling the rare earth-iron-boron alloy powder thus formed, then dry pressing under a magnetic field which is either parallel or perpendicular to the pressing direction, parallel pressing being preferred. The compact thus obtained is then sintered at about 1000° C. to about 1200° C. and then heat treated at about 500° C. to about 800° C. under an inert atmosphere, preferably, an argon atmosphere, in order to obtain the finished permanent magnet.

The following examples are offered to assist the understanding of the present invention and are not intended to limit its scope.

EXAMPLE 1

The composition of the rare earth-iron-boron alloy to be prepared, i.e., the target alloy, was:

35% by weight neodymium (Nd)
3.7% by weight iron (Fe)
1.3% by weight boron (B)

The starting materials were:

| | | |
|---|---|---|
| $Nd_2O_3$ (powder) | 81.6 g | |
| Fe (powder) | 116.7 g | |
| FeB (powder) (which contained 19.6 wt % B—Fe alloy, based on the total weight of FeB powder | 13.3 g | |
| Ca (metallic granules) | 43.7 g | (which amount corresponded to 1.5 times the stoichiometric amount necessary for the reduction of $Nd_2O_3$) |
| seed alloy (powder) | 20 g | |

The composition of the seed alloy powder was the same as that of the target alloy. The distribution of the particle sizes of the seed alloy powder was 5–100μm; the particle size was 110μm.

The starting materials were well mixed and dry pressed into pellets. The pellets were placed into a stainless steel container which was placed into a tubular furnace having an argon atmosphere and heated at a temperature of 1200° C. for a period of time of 120 min., after which time the reduction/diffusion reaction was complete. The reaction product, recovered in the form of a reacted compact, was allowed to cool down in the furnace to room temperature after which it was discharged from the furnace.

The cooled reacted compacts were then crushed into a powder having a size below 60 mesh. The powder was then placed into deionized water at a temperature of 25° C. and stirred at 3000 rpm under a nitrogen atmosphere for a period of time of 60 min. Stirring was stopped and the slurry was allowed to settle. After settling, the water layer was decanted; a rare earth-iron-boron alloy sediment remained.

The alloy sediment was then washed 4 times with 2000 mls of deionized water (per wash); decantation of the water layer being repeated after each wash. After the washing, dilute 0.3 molar acetic acid was added in dropwise fashion to the alloy sediment to adjust the pH to between 4 and 10. The alloy sediment was then filtered and washed 3 times with deionized water until the pH was 6 to 7.

Residual water in the resulting alloy sediment was removed by the addition of 500 mls of acetone which, in turn, was removed by vacuum drying. The rare earth-iron-boron target alloy powder was thus recovered. The composition of this alloy powder was then analyzed using Inductively Coupled Plasma-Atomic Emission Spectroscopy (ICP-AES), Atomic Absorption Spectroscopy (AAS) and Nitrogen/Oxygen analysis. The composition of the rare earth-iron-boron alloy powder was:

Nd: 34.6 wt %
Fe: 63.3 wt %
B: 1.2 wt %
Ca: 2100 ppm
O: 5800 ppm
C: 700 ppm

The grain size distribution of the rare earth-iron-boron alloy powder ranged from several microns to 250 microns.

A finished permanent magnet was fabricated from the rare earth-iron-boron alloy powder thus obtained. The alloy powder was ball milled and then dry pressed under a magnetic field which was parallel to the direction of the pressing. The pressed compact was sintered at 1000° C.-1200° C. for a period of time of 60 min. and then heat treated at 500° C.-800° C. for a period of time of 120 min., both under an argon atmosphere. The finished permanent magnet thus obtained was found to have the following magnetic properties:

Remanence, Br (kiloGauss, kG)=10.2
Coercive force, iHc (kilo-Oersteds, kOe)=10.0
Maximum Energy Product, (BH)max=24.7 (Gauss-Oersteds $X10^{-6}$, MGOe)

COMPARATIVE EXAMPLE 1

The composition of the rare earth-iron-boron alloy powder to be prepared was the same as that of Example 1. The starting materials were:

| | | |
|---|---|---|
| $Nd_2O_3$ (powder) | 81.6 g | |
| Fe (powder) | 116.7 g | |
| FeB (powder) (which contained 19.6 wt % B—Fe alloy, based on the total weight of FeB powder | 13.3 g | |
| Ca (metallic granules) | 43.7 g | (which amount corresponded to 1.5 times the stoichiometric amount necessary for the reduction of $Nd_2O_3$) |

For comparative purposes, no seed alloy was added to the starting materials. The rare earth-iron-boron alloy powder was prepared from these starting materials according to the procedure of Example 1. The composition of the rare earth-iron-boron alloy powder thus produced was determined to Nd: 34.4 wt %
Fe: 63.4 wt %
B: 1.2 wt %
Ca: 3200 ppm
O: 6700 ppm
C: 650 ppm As can be seen by comparison with the rare earth-iron-boron alloy powder of Example 1 (whose starting materials included a seed alloy), there is significantly more calcium and oxygen and contaminants in the alloy powder of Example 2 made with no seed alloy.

A permanent magnet fabricated from the alloy powder of Example 2 utilizing the procedure of Example 1 exhibited the following magnetic properties:

Br=9.7 kG
iHc=9.1 kOe
$(BH)_{max}$=21.0 MGOe

A comparison of these magnetic properties with those of the magnet formed in Example 1 shows that when a seed alloy is used in the starting materials, magnetic properties are enhanced in the final permanent magnet.

EXAMPLE 2

The composition of the rare earth-iron-boron alloy powder to be prepared was:

31% by weight Nd
3% by weight Dy
64.7% by weight Fe
1.3% by weight B

The starting materials were:

| | | |
|---|---|---|
| $Nd_2O_3$ (powder) | 72.3 g | |
| Fe (powder) | 118.7 g | |
| FeB (powder) (which contained 19.6 wt % B—Fe alloy based on the total weight of FeB powder) | 13.3 g | |
| $Dy_2O_3$ (powder) | 6.9 g | |
| Ca (metallic granules) | 56 g | (which amount corresponded to 2.0 times of the stoichiometric amount necessary for the reduction of $Nd_2O_3$ and $Dy_2O_3$) |
| seed alloy (powder) | 10 g | |

The composition of the seed alloy powder was the same as that of the rare earth-iron-boron alloy powder to be prepared. For this example, the particle sizes of the seed alloy used were varied in three Samples (a)-(c) from: (a) 5-44μm, (b) 44-88μm, (c) 88-200μm. For comparative purposes, Sample (d) was made from the above starting materials except that no seed alloy was added. The rare earth-iron-boron alloy powders representing Samples (a)-(d) were prepared according to the procedure of Example 1. The compositions of the rare earth-iron-boron alloy powders of Samples (a)-(d) were:

| | Sample | | | |
|---|---|---|---|---|
| | (a) | (b) | (c) | (d) |
| Nd (wt %) | 30.7 | 30.7 | 30.6 | 36.6 |
| Dy (wt %) | 3 | 3 | 2.9 | 2.9 |
| Fe (wt %) | 64.3 | 64.4 | 64.3 | 64.3 |
| B (wt %) | 1.3 | 1.2 | 1.2 | 1.2 |
| Ca (ppm) | 510 | 900 | 1900 | 3100 |
| O (ppm) | 3500 | 4900 | 6200 | 6800 |
| C (ppm) | 610 | 570 | 590 | 600 |

As can be seen from the above, Sample (d) showed substantially higher levels of calcium and oxygen contamination than Samples (a)–(c) and had a higher carbon contamination relative to Samples (b) and (c), where the seed alloy had a particle size range of 44–88μm and 88–200μm, respectively.

Permanent magnets fabricated from Samples (a)–(d) using the procedure of Example b 1 exhibited the following magnetic properties:

| | Sample | | | |
|---|---|---|---|---|
| | (a) | (b) | (c) | (d) |
| Br (kG) | 10.8 | 10.1 | 9.2 | 8.8 |
| iHc (kOe) | 16 | 15.3 | 14.8 | 14.2 |
| (BH) max (MGOe) | 26.8 | 23.4 | 19.0 | 17.4 |

As can be seen from the above, Sample (d), prepared without a seed alloy, exhibited weaker magnetic properties than Samples (a)–(c) which were prepared with a seed alloy in accordance with the present invention. Also evident from the above is that as the particle size of the seed alloy approaches the 5–44μm range (Sample (a)) magnetic properties were maximal.

EXAMPLE 3

The composition of the rare earth-iron-boron alloy powder to be prepared was as follows:

29.5% by weight Nd
4.5% by weight Dy
49.9% by weight Fe
14% by weight Co
0.9% by weight Al
1.2% by weight B The starting materials were:

| | | |
|---|---|---|
| $Nd_2O_3$ (powder) | 68.8 g | |
| $Dy_2O_3$ (powder) | 10.3 g | |
| Fe (powder) | 90 g | |
| Co (powder) | 28 g | |
| $Al_2O_3$ (powder) | 3.4 g | |
| FeB (powder) (which contained 19.6 wt % B—Fe alloy, based on the total weight of FeB powder) | 12.2 g | |
| Ca (metallic granules) | 54.1 g | (which amount corresponded to 1.7 times the stoichiometric amount necessary for the reduction of $Nd_2O_3$, $Dy_2O_3$ and $Al_2O_3$) |
| seed alloy (powder; particle size was 5–44 μm) | | see Samples (e)–(g) |

The composition of the seed alloy powder was the same as that of the rare earth-iron-boron alloy powder to be prepared. For this Example, the particle size of the seed alloy was 5–44μm. The amount of seed alloy used (in grams, g) in three Samples, (e)–(g), was varied from: (e) 4g, (f) 10g and (g) 20g. The weight percentages of seed alloy used in Samples (e)–(g), relative to the amount of rare earth-iron-boron alloy powder to be prepared (in this example 200 grams of rare earth-iron-boron alloy powder was to be prepared), were: (e) 2%, (f) 5% and (g) 10%. The rare earth-iron-boron alloy powder was prepared according to the procedure of Example 1. The compositions of rare earth-iron-boron alloy powders of Samples (e)–(g) were:

| | Sample | | |
|---|---|---|---|
| | (e) | (f) | (g) |
| Nd (wt %) | 29.3 | 29.2 | 29.3 |
| Dy (wt %) | 4.4 | 4.5 | 4.4 |
| Fe (wt %) | 49.7 | 49.8 | 49.7 |
| Co (wt %) | 14 | 13.9 | 13.9 |
| Al (wt %) | 0.9 | 0.9 | 0.9 |
| B (wt %) | 1.1 | 1.2 | 1.2 |
| Ca (ppm) | 850 | 480 | 490 |
| O (ppm) | 4100 | 3200 | 3300 |
| C (ppm) | 560 | 670 | 590 |

As can be seen from the above, the contamination caused by calcium and oxygen is lowest when the seed alloy is employed in an amount of approximately 5% by weight based on the total weight of the rare earth-iron-boron alloy to be prepared (Sample (f)). Carbon contamination is lowest when the seed alloy is present in an amount of 2% by weight (Sample (e)).

Permanent magnets fabricated from Samples (e)–(g) using the procedure of Example 1 exhibited the following magnetic properties:

| | Sample | | |
|---|---|---|---|
| | (e) | (f) | (g) |
| Br (kG) | 9.5 | 9.9 | 9.8 |
| iHc (kOe) | 16.0 | 16.5 | 16.4 |
| (BH) max (MGOe) | 22.2 | 24.5 | 24.3 |

As can be seen from the above, the magnetic properties are maximal for Sample (f) where the seed alloy was present in the starting materials in an amount of 5% by weight based on the total weight of the rare earth-iron-boron alloy to be prepared.

As mentioned earlier, the present invention is characterized by the addition, in the starting materials, of a small amount of R—Fe—B alloy powders which act as seed powders. These seed powders have substantially the same composition as that of the target or intended rare earth-iron-boron alloy powders. The seed powders function to improve the reduction/diffusion process by ensuring that the alloy grains formed will be of a large and uniform size and that unreacted calcium and calcium oxide by-product will be more thoroughly removed by subsequent wet processing. The rare earth-iron-boron alloy powders thus obtained have minimal content of residual calcium and oxygen, and permanent magnets made therefrom have excellent magnetic properties.

What is claimed is:

1. A process for preparing a rare earth-iron-boron alloy said process comprising the steps of:

(a) heating in an inert atmosphere a mixture of:
  (i) at least one rare earth oxide
  (ii) at least one ferroboron-containing compound
  (iii) calcium
  (iv) iron
  (v) a rare earth-iron-boron seed alloy, said seed alloy having substantially the same composition as the rare earth-iron-boron alloy powder to be prepared, said heating occurring under conditions sufficient to form a reduction/ diffusion reaction product said reduction/diffusion reaction product containing the rare earth-iron-boron alloy;

(b) recovering said reduction/diffusion reaction product in the form of particles having a size of less than about 60 mesh; and (c) contacting in a second inert atmosphere said reduction/diffusion reaction product with water under conditions sufficient to separate the rare earth-iron-boron alloy from said reduction/diffusion reaction product.

2. The process of claim 1 wherein Step (c) further comprises adjusting the pH of said water to the range of between about 4 to about 10.

3. The process of claim 2 wherein said adjusting of said pH is accomplished by an acid.

4. The process of claim 3 wherein said acid is acetic acid.

5. The process of claim 1 wherein said water is deionized water.

6. The process of claim 1 wherein said mixture is provided in the form of pellets.

7. The process of claim 1 wherein said heating is at a temperature in the range of between about 800° C. to about 1300° C.

8. The process of claim 7 wherein said heating is for a time sufficient to form said reduction/diffusion product.

9. The process of claim 1 wherein the inert atmosphere of step (a) is argon.

10. The process of claim 1 wherein said recovering of said reduction/diffusion product in the form particles having a size of less than about 60 mesh includes crushing.

11. The process of claim 1 wherein Step (b) further comprises cooling said reduction/diffusion reaction product.

12. The process of claim 1 wherein said water is agitated.

13. The process of claim 1 wherein said second inert atmosphere is nitrogen.

14. The process of claim 1 wherein said mixture further comprises cobalt.

15. The process of claim 14 wherein said cobalt is present in an amount of up to about 20% by weight based on the total weight of said mixture.

16. The process of claim 15 wherein said cobalt is present in an amount of between about 10% to about 15% by weight based on the total weight of said mixture.

17. The process of claim 1 wherein said mixture further comprises aluminum oxide.

18. The process of claim 17 wherein said aluminum oxide is present in an amount of up to about 5% by weight based on the total weight of said mixture.

19. The process of claim 18 wherein said aluminum oxide is present in an amount of between about 0.5% to about 2% by weight based on the total weight of said mixture.

20. The process of claim 1 wherein said at least one rare earth oxide is present in an amount of up to about 40% by weight of said mixture.

21. The process of claim 20 wherein said at least one rare earth oxide is present in an amount of between about 25% to about 30% by weight based on the total weight of said mixture.

22. The process of claim 1 wherein said at least one ferroboron compound is present in an amount of up to about 10% by weight based on the total weight of said mixture.

23. The process of claim 22 wherein said at least one ferroboron compound is present in an amount of between about 4% to about 6% by weight based on the total weight of said mixture.

24. The process of claim 1 wherein said ferroboron-containing compound contains a boron-iron alloy.

25. The process of claim 24 wherein said boron-iron alloy is present in an amount of between about 10% to about 30% by weight based on the total weight of said ferroboron-containing compound.

26. The process of claim 25 wherein said boron-iron alloy is present in an amount of about 20% by weight based on the weight total of said ferroboron-containing compound.

27. The process of claim 1 wherein said calcium is present in an amount of up to about 30% by weight based on the total weight of said mixture.

28. The process of claim 27 wherein said calcium is present in an amount of between about 15% to about 20% by weight based on the total weight of said mixture.

29. The process of claim 1 wherein said iron is present in an amount of up to about 50% by weight based on the total weight of said mixture.

30. The process or claim 29 wherein said iron is present in an amount of between about 30% to about 45% by weight on the total weight of said mixture.

31. The process of claim 1 wherein said seed alloy is present in an amount up to about 20% by weight based on the total weight of rare earth-iron-boron alloy to be prepared.

32. The process of claim 31 wherein said seed alloy is present in an amount of between about 2% to about 10% by weight based on the total weight of rare earth-iron-boron alloy to be prepared.

33. The process of claim 32 wherein said seed alloy is present in an amount of about 5% by weight based on the total weight of rare earth-iron-boron alloy to be prepared.

34. The process of claim 1 wherein said rare earth oxide contains at least one element having an atomic number of 57 to 71.

35. The process of claim 34 wherein said at least one element is neodymium, praseodymium or mixtures thereof.

36. The process of claim 35 wherein said at least one element further comprises dysprosium, cerium, lanthanum, promethium, samarium, europium, gadolinium, terbium, holmium, erbium, thulium, ytterbium, lutetium or mixtures thereof.

37. The process of claim 36 wherein said dysprosium, cerium, lanthanum, promethium, samarium, europium, gadolinium, terbium, holmium, erbium, thulium, ytterbium, lutetium is present in an amount of up to about 10% by weight based on the total weight of said mixture.

38. The process of claim 37 wherein said dysprosium, cerium, lanthanum promethium, samarium europium, gadolinium, terbium, holmium, erbium, thulium, ytterbium, lutetium is present in an amount of between about 3% to about 4.5 % by weight based on the total weight of said mixture.

39. The process of claim 1 wherein said seed alloy has a particle size in the range of between about 1 to about 200μm.

40. The process of claim 39 wherein said seed alloy has a particle size in the range of between about 5 to about 44μm.

41. In a process for preparing a rare earth-iron-boron alloy powder by a reduction/diffusion method wherein the starting materials include at least one rare earth oxide, at least one ferroboron-containing compound, calcium, iron and optionally cobalt and/or aluminum oxide, the improvement comprising:

adding to the starting materials a seed alloy, said seed alloy having substantially the same composition as the rare earth-iron-boron alloy to be prepared by the reduction/ diffusion method.

42. The process of claim 41 wherein said seed alloy is present in an amount of up to about 20% by weight based on the total weight of said starting materials.

43. The process of claim 42 wherein said seed alloy is present in an amount of between about 2% to about 10% by weight based on the total weight of said starting materials.

44. The process of claim 41 wherein said seed alloy has a particle size in the range of between about 1 to about 200μm.

45. The process of claim 44 wherein said seed alloy has a particle size in the range of between about 5 to about 44μm.

* * * * *

UNITED STATES PATENT AND TRADEMARK OFFICE

CERTIFICATE OF CORRECTION

PATENT NO. : 5,064,465

DATED : November 12, 1991

INVENTOR(S) : Chi-Jen Chen, et al.

It is certified that error appears in the above-identified patent and that said Letters Patent is hereby corrected as shown below:

Column 2, line 12: "ally" should read as --alloy--

Column 6, line 29: "3.7%" should read as --63.7%--

Column 6, line 38: "powder" should read as --powder)--

Column 6, line 50: "the particle" should read as --the average particle--

Column 7, line 52: "powder" should read as --powder)--

Column 7, line 65: "to" should read as --to be:--

Column 9, line 6: delete "b"

Column 12, line 25, Claim 30: "or" should read as --of--

Signed and Sealed this

Twenty-fifth Day of May, 1993

*Attest:*

*Attesting Officer*

Michael K. Kirk

MICHAEL K. KIRK

*Acting Commissioner of Patents and Trademarks*